US009693153B2

(12) United States Patent
Kindred

(10) Patent No.: US 9,693,153 B2
(45) **Date of Patent: *Jun. 27, 2017**

(54) METHOD AND APPARATUS FOR SUPPRESSING TRANSIENT SOUNDS IN HEARING ASSISTANCE DEVICES

(71) Applicant: Starkey Laboratories, Inc., Eden Prairie, MN (US)

(72) Inventor: Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/722,558

(22) Filed: May 27, 2015

(65) Prior Publication Data

US 2016/0353214 A1 Dec. 1, 2016

(51) Int. Cl.
*H04R 25/00* (2006.01)

(52) U.S. Cl.
CPC ..... *H04R 25/505* (2013.01); *H04R 2225/43* (2013.01)

(58) Field of Classification Search
CPC ..... H04R 25/00
USPC ..... 381/321, 317
See application file for complete search history.

(56) References Cited

U.S. PATENT DOCUMENTS 4,052,568 A 10/1977 Jankowski
5,396,560 A 3/1995 Arcos et al.
2003/0012393 A1* 1/2003 Armstrong ..... G01R 19/02 381/321
2009/0028367 A1* 1/2009 Klinkby ..... H04R 25/453 381/318
2011/0268301 A1* 11/2011 Nielsen ..... G10L 21/02 381/321
2014/0058478 A1* 2/2014 Fruhauf ..... A61N 1/36032 607/57

FOREIGN PATENT DOCUMENTS

WO WO-9613096 A1 5/1996
WO WO-2007031499 A1 3/2007
WO WO-2010083879 A1 7/2010

OTHER PUBLICATIONS

"U.S. Appl. No. 14/722,392, Notice of Allowance mailed Sep. 6, 2016", 10 pgs.
"European Application Serial No. 16171659.2, Extended European Search Report mailed Oct. 6, 2016", 5 pgs.

* cited by examiner

*Primary Examiner* — Duc Nguyen
*Assistant Examiner* — Phan Le
(74) *Attorney, Agent, or Firm* — Schwegman, Lundberg & Woessner, P.A.

(57) ABSTRACT

An audio system includes a transient suppression circuit that rectifies an input signal representing target sounds and transient sounds and produces a threshold envelope of the rectified input signal. The transient suppression circuit accumulates the difference between the rectified input signal and the threshold envelope, and normalizes the accumulated difference using the rectified input signal. A gain is calculated using this normalized accumulated difference and applied to the input signal to suppress the transient sounds without substantially affecting the target sounds.

20 Claims, 4 Drawing Sheets

METHOD AND APPARATUS FOR SUPPRESSING TRANSIENT SOUNDS IN HEARING ASSISTANCE DEVICES

TECHNICAL FIELD

This document relates generally to hearing assistance devices and more particularly to a computationally efficient method and apparatus for transient sound suppression.

BACKGROUND

One or more hearing instruments may be worn on one or both sides of a person's head to deliver sounds to the person's ear(s). An example of such hearing instruments includes one or more hearing aids that are used to assist a patient suffering hearing loss by transmitting amplified sounds to one or both ear canals of the patient. While the patient (hearing aid wearer) benefits from amplified sounds such as speech and music, other sounds when being amplified may be unpleasant. For example, for many hearing aid wearers, especially those who are new to wearing hearing aids, transient sounds can be very unpleasant. Examples of the transient sounds include sounds of placing dishes or silverware on a hard surface and the closing of cupboards or doors. While such transient sounds may not be loud enough to trigger output compression limiting, they may still be perceived by hearing aid wearers as annoying. Thus, there is a need to reduce the harshness of the transient sounds while not affecting the sounds that are intended to be heard by the hearing aid wearers.

SUMMARY

An audio system includes a transient suppression circuit that rectifies an input signal representing target sounds and transient sounds and produces a threshold envelope of the rectified input signal. The transient suppression circuit accumulates the difference between the rectified input signal and the threshold envelope, and normalizes the accumulated difference using the rectified input signal. A gain is calculated using this normalized accumulated difference and applied to the input signal to suppress the transient sounds without substantially affecting the target sounds.

In one embodiment, a hearing assistance device includes a microphone to receive input sounds and produce an input signal representing the input sounds, a speaker configured to receive an output signal and produce output sounds based on the output signal, and a processing circuit to produce the output signal by processing the input signal. The processing circuit includes a rectifier, a threshold envelope generator, an accumulator, a normalizer, a gain calculator, and an amplifier. The rectifier rectifies the input signal. The threshold envelope generator generates a threshold signal being an envelope of the rectified input signal. The accumulator produces an accumulator value by accumulating a difference between an amplitude of the rectified input signal and an amplitude of the threshold signal. The normalizer normalizes the accumulator value using the rectified input signal. The gain calculator determines an applied gain using the normalized accumulator value. The amplifier produces the output signal by applying the applied gain to the input signal.

A method for operating a hearing assistance device is provided. In one embodiment, the method includes receiving an input signal representing input sounds, transmitting output sounds to an ear canal of a listener, and processing the input signal to produce the output sounds, including attenuating transient sounds using a time-domain process. The time-domain process includes rectifying the input signal, generating a threshold signal being an envelope of the rectified input signal, accumulating a difference between an amplitude of the rectified input signal and an amplitude of the threshold signal, normalizing the accumulated difference using the rectified input signal, determining an applied gain using the normalized accumulated difference, and applying the applied gain to the input signal.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
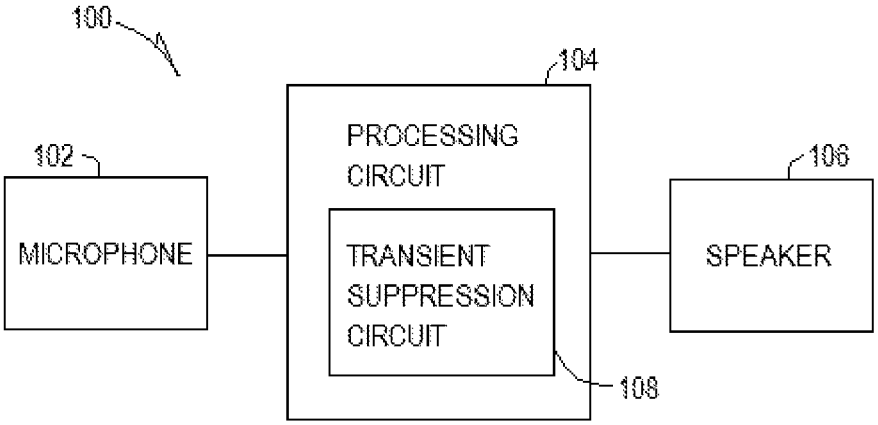
FIG. 1 is a block diagram illustrating an embodiment of an audio system with transient sound suppression.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present document discusses an audio system, such as a hearing assistance system, that suppresses transient sounds in processing an acoustic signal that is to be delivered to a listener such as a hearing aid wearer. In this document, "transient suppression" includes reduction or attenuation of transient sounds. A "transient sound", as referred to as a "transient" is a sound of high amplitude and short duration at the beginning of a waveform that may occur in phenomena such as music, speech, or noises. A transient may include any sudden change in the amplitude of an acoustic signal, such as a sudden "wideband event" in an acoustic signal that is otherwise a substantially steady-state signal. The listener of the hearing assistance system, such as the hearing aid wearer, may find transient sounds particularly loud and annoying, especially when the transient sounds include noises such as sounds from slamming doors, dropping a hard object on a hard surface, and other sounds that the listener would not care to hear. Various systems perform transient suppression by quickly reducing the gain in the sound processing when a transient sound occurs, and then quickly revert to the original gain. The goal is to suppress the transient sounds (that causes discomfort when heard by the listener) while not affecting the delivery of speech, music and other environmental sounds that are intended to be heard by the listener. In some known examples, transient suppression is performed by using frequency domain analysis or spectral flux methods.

The present subject matter achieves transient suppression using a broadband time domain processing that is computationally efficient. In various embodiments, the present audio system reduces objectionable audio transients, while not substantially affecting other sounds, at a low computational cost. The low computational cost, among other things, makes the present subject matter suitable for use in a hearing aid where computational resources are limited.

In various embodiments, the present audio system detects transient sounds in an input signal by accumulating difference between the rectified input signal and a smoothed envelope of the input signal. Waveforms such as those typically seen in speech and music signals are substantially unaffected, while waveforms of percussive transient sounds trigger suppression of the transient sounds. In various embodiments, by suppressing the transient sounds, the present audio system provides listening comfort. When not being bothered by loud transient sounds, the listener may choose to increase the volume of the sound (processed input signal) delivered to him or her, which may improve speech intelligibility.

In various embodiments, the present audio system can be configured to generate a detection signal being the accumulation of the amount by which the input signal exceeds a dynamically changing threshold, normalize the detection signal using the input signal, and generate a target gain for the processing of the input signal (sound) from the normalized detection signal.

FIG. 1 is a block diagram illustrating an embodiment of an audio system 100 with transient sound suppression. One example of audio system 100 includes a hearing assistance system. The hearing assistance system may include one or more hearing aids configured to be worn by a listener (hearing aid wearer) who may suffer hearing loss by delivering amplified sound to the listener to compensate for the hearing loss. System 100 includes a microphone 102, a speaker 106, and a processing circuit 104 coupled between microphone 102 and speaker 106. Microphone 102 receives input sounds from the listener's environment and produces an input signal representing the input sounds. The input sounds may include target sounds and transient sounds. The target sounds are sounds intended to be heard by the listener, such as speech, music, and audio notifications such as those generated from home electric appliances. Transient sounds include short-duration sounds that may be loud and annoying to the listener. Processing circuit 104 produces an output signal by processing the input signal representing the input sounds. Speaker 106 (also known as a receiver in a hearing assistance system) produces output sounds using the output signal and transmits the output sounds to the listener. Processing circuit 104 includes a transient suppression circuit 108 that suppresses the transient sounds in the input sounds. In various embodiments, transient suppression circuit 108 substantially attenuates the transient sounds without substantially affecting the target sounds in the input sounds.

In various embodiments, transient suppression circuit 108 rectifies the input signal and produces a threshold envelope that is used as a comparison threshold for calculating a magnitude of the transient sounds, and a normalization signal that is used to normalize the calculation based on the general loudness of the input signal (which conveys the loudness of the environment). The threshold envelope has fast time constants to follow the general envelope of the rectified input signal, and may be scaled by threshold shift. Transient suppression circuit 108 then adds the difference between the rectified input signal and the scaled threshold envelope to an accumulator. This accumulated difference increases at the onset of sudden increases in the level of the rectified input signal, and is scaled by the normalization signal, which has an amplitude that varies with the level of the rectified input signal. The normalized difference between the rectified input signal and the scaled threshold envelope is then used to determine a gain that is applied to the input signal to produce the output signal.

Figure 2:
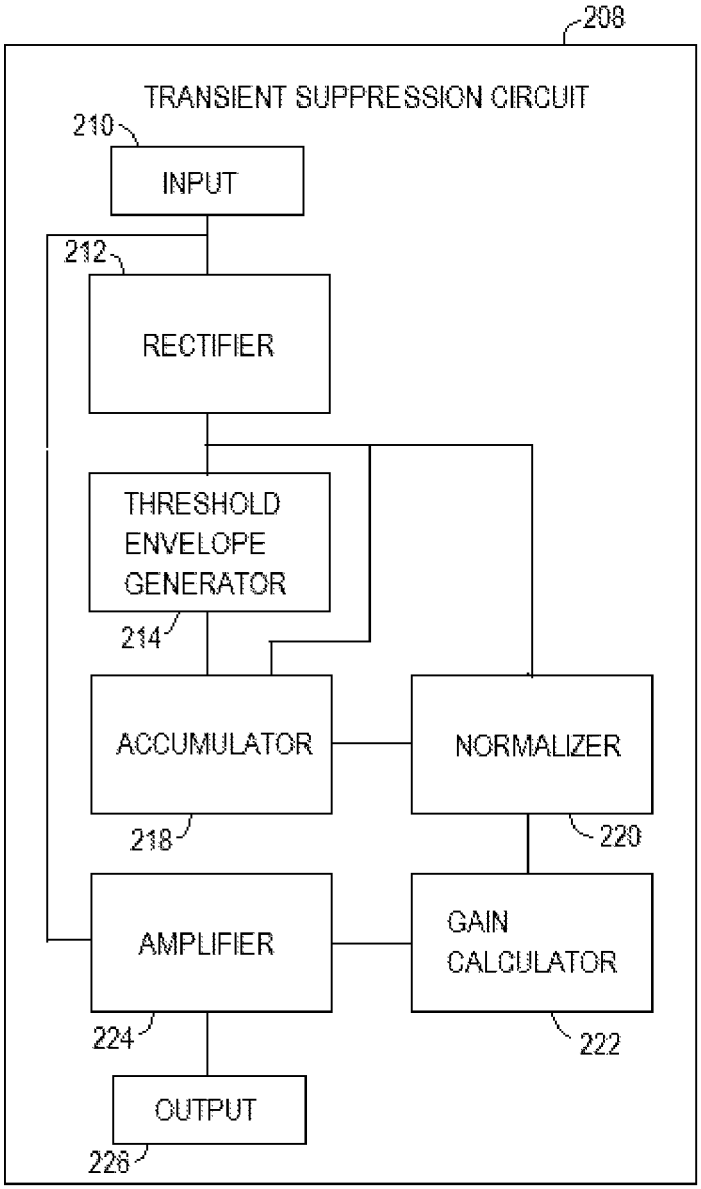
FIG. 2 is a block diagram illustrating an embodiment of a transient suppression circuit.

FIG. 2 is a block diagram illustrating an embodiment of a transient suppression circuit 208, which represents an embodiment of transient suppression circuit 108. In the illustrated embodiment, transient suppression circuit 208 includes an input 210, a rectifier 212, a threshold envelope generator 214, an accumulator 218, a normalizer 220, a gain calculator 222, an amplifier 224, and an output 226.

Input 210 receives the input signal, such as from microphone 102. In various embodiments, processing circuit 104 may precondition the input signal before it is received by input 210. The preconditioning may include, but is not limited to, amplification, filtering, digitization, and/or decimation. Rectifier 212 rectifies the input signal. Threshold envelope generator 214 generates a threshold signal being an envelope of the rectified input signal. Accumulator 218 produces an accumulator value by accumulating a difference between an amplitude of the rectified input signal and an amplitude of the threshold signal. Normalizer 220 normalizes the accumulator value to keep performance of the transient suppression consistent across various levels of the input signal. Gain calculator 222 determines an applied gain using the normalized accumulator value. Amplifier 224 produces the output signal by applying the applied gain to the input signal. Output 226 relays the output signal, such as to speaker 106. In various embodiments, processing circuit 104 may further process the input and/or the output signal before the output signal is received by speaker 106. Such further processing may include, but is not limited to, application of various sound processing techniques such as feedback cancellation, directionality control, spatial perception enhancement, speech intelligibility enhancement, and/or reduction of noises other than the transient sounds.

Figure 3:
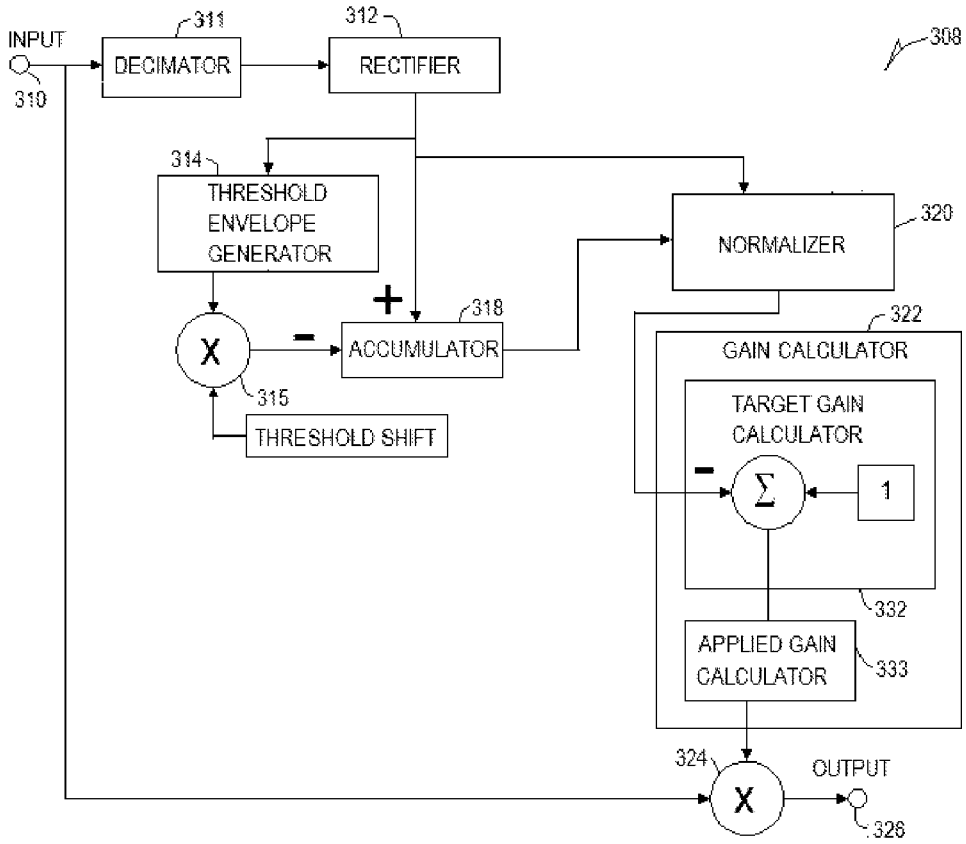
FIG. 3 is a block diagram illustrating another embodiment of the transient suppression circuit.

FIG. 3 is a block diagram illustrating an embodiment of a transient suppression circuit 308, which represents an embodiment of transient suppression circuit 208. In the illustrated embodiment, transient suppression circuit 308 includes an input 310, a decimator 311, a rectifier 312, a threshold envelope generator 314, a threshold scaling multiplier 315, an accumulator 318, a normalizer 320, a gain calculator 322, an output multiplier 324, and an output 326. Various other embodiments of transient suppression circuit 208 may include more or less circuit elements. For example, decimator 311 may be used, and its decimation factor may be determined, based on the overall computational cost of processing circuit 104.

In various embodiments, processing circuit 308 includes a digital circuit that processes signals in digital domain. Input 310 receives the input signal, which is digitized. In one embodiment, as illustrated in FIG. 3, decimator 311 decimates the input signal. In one embodiment, decimator 311 decimates the input signal by summing 8 samples and shifting right 3 places. In another embodiment decimator 311 decimates the input signal by a decimation factor of 8. Rectifier 312 represents an embodiment of rectifier 212 and rectifies the decimated input signal.

Threshold envelope generator 314 represents an embodiment of threshold envelope generator 214 and generates a threshold signal. The threshold signal is a time domain broadband signal that is an envelope of the rectified input signal. Threshold scaling multiplier 315 scales the threshold signal by multiplying the threshold signal by a threshold shift.

Accumulator 318 represents an embodiment of accumulator 218 and produces an accumulator value by accumulating the difference between the amplitude of the rectified input signal and the amplitude of the threshold signal. The accumulator value (i.e., the accumulated difference between the amplitude of the rectified input signal and the amplitude of the threshold signal) shows a large peak corresponding to the onset of a transient sound. This peak will result in a sudden decreases in a gain value applied to the input signal, and that gain value recovers quickly to unity at a specified rate, as discussed with respect to gain calculator 322 below.

Normalizer 320 represents an embodiment of normalizer 220 and normalizes the accumulator value to keep performance of the transient suppression consistent across various levels of the input signal.

Gain calculator 322 represents gain calculator 222 and produces an applied gain using the normalized accumulator value. The applied gain is to be applied to the input signal to produce the output signal. Gain calculator 322 includes a target gain calculator 332 and an applied gain calculator 333. Target gain calculator 332 calculates a target gain using the normalized accumulator value. In one embodiment, target gain calculator 332 dynamically calculates the target gain by subtracting the normalized accumulator value from 1 (i.e., target gain=1−normalized accumulator value), and sets the target gain to a minimum target gain value when the calculated target gain is less than the minimum target gain. Applied gain calculator 333 dynamically determines the applied gain based on the target gain. In one embodiment, applied gain calculator 333 sets the applied gain to the target gain when the applied gain is greater than the target gain, and determines the applied gain using the target gain and a rise rate parameter when the applied gain is not greater than the target gain. In various embodiments, when the applied gain is not greater than the target gain, applied gain calculator 333 determines the applied gain as a sum of the applied gain and the applied gain multiplied by the rise rate parameter. The rise rate parameter controls a recovery time of the applied gain. This keeps the applied gain at a low level for a brief period of time after the threshold level has increased enough to drop the accumulator value, which increases the target gain. In various embodiments, applied gain calculator 333 sets the applied gain to 1 when the determined applied gain exceeds 1.

Output multiplier 324 represents an embodiment of amplifier 224 and produces the output signal by multiplying the input signal by the applied gain. Output 324 relays the output signal to speaker 106 or other portions of processing circuit 104 for additional processing.

Figure 4:
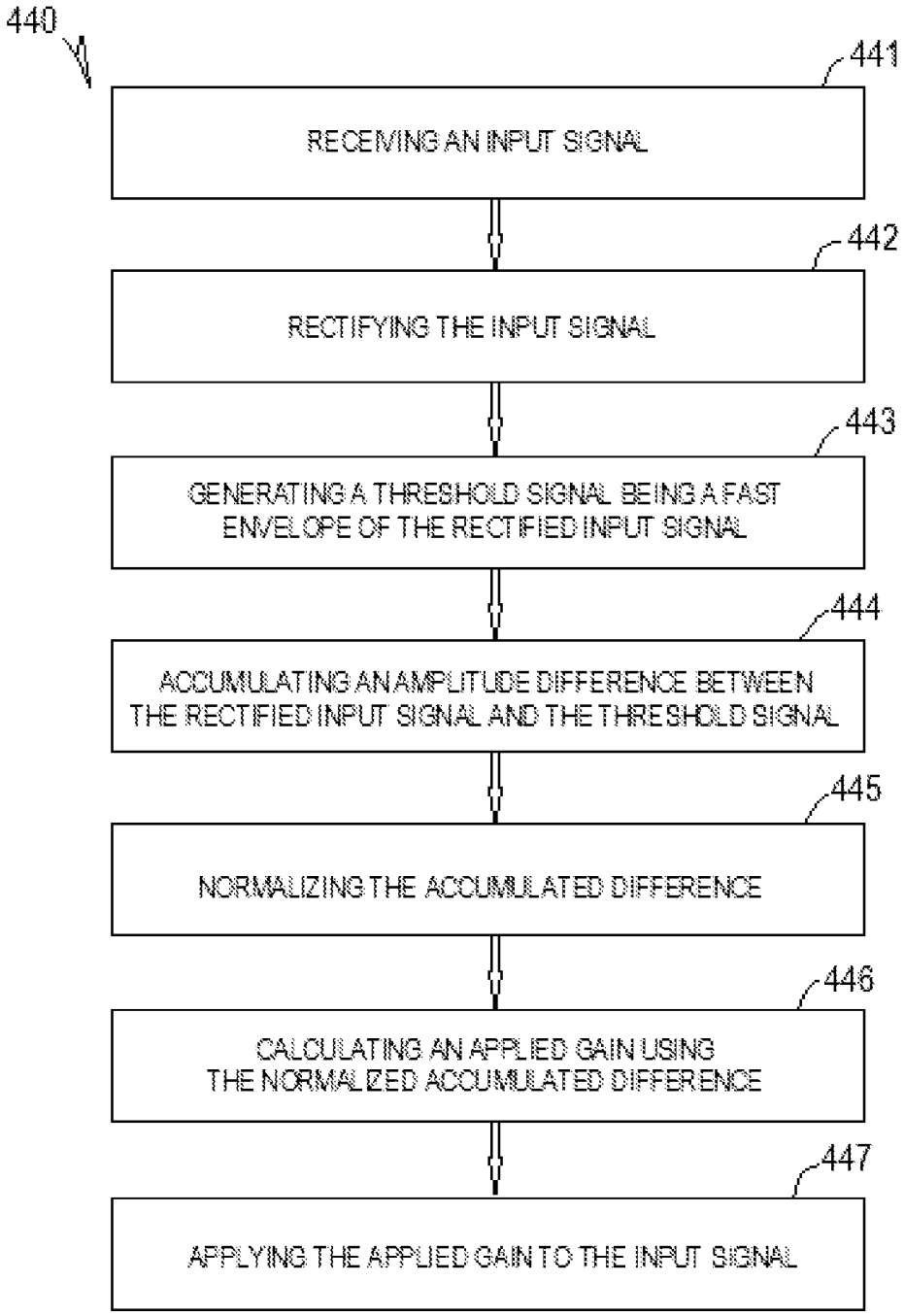
FIG. 4 is a flow chart illustrating an embodiment of a method for transient sound suppression.

FIG. 4 is a flow chart illustrating an embodiment of a method 440 for transient sound suppression. In various embodiments, transient suppression circuit 208 or 308 can be configured to perform method 440.

At 441, an input signal is received. In various embodiments, the input signal is received from a microphone of a hearing assistance device such as a hearing aid and represents input sounds received from the environment of the listener such as a hearing aid wearer. The input signal is to be processed to produce output sounds for delivery to the listener using the hearing assistance device. The input sounds may include target sounds and transient sounds. In various embodiments, method 400 is performed to attenuate the transient sounds using a time-domain process.

In various embodiments, the input signal may be decimated in various ways. In one embodiment, the input signal is decimated using a decimation factor of 8. In one embodiment, the input signal is decimated by summing 8 samples and shifting right 3 places.

At 442, the input signal is rectified. If the input signal is decimated, the rectified signal is the rectified decimated signal.

At 443, a threshold signal is generated. The threshold signal is an envelope of the rectified input signal generated. The envelope is a time domain broadband signal. In one embodiment, the envelope is scaled to be used as the threshold signal.

At 444, a difference between an amplitude of the rectified input signal and an amplitude of the threshold signal is accumulated by using an accumulator. The accumulated difference is also referred to as the accumulator value.

At 445, the accumulated difference (accumulator value) is normalized using the input signal. This allows method 440 to be performed consistently across variations in the level of the input signal. In various embodiments, the accumulated difference is normalized by multiplying the accumulated difference with a normalization signal produced using the input signal or the rectified input signal.

At 446, an applied gain is determined using the normalized accumulated difference. In one embodiment, the applied gain is determined by dynamically calculating a target gain using the normalized accumulated difference and dynamically determining the applied gain based on the target gain. In one embodiment, the target gain is dynamically calculated by calculating the target gain by subtracting the normalized accumulated difference from 1 (i.e., target gain=1−normalized accumulator value) and setting the target gain to a minimum target gain value when the calculated target gain is less than the minimum target gain. In one embodiment, the applied gain is dynamically determined by setting the applied gain to the target gain when the applied gain is greater than the target gain and setting the applied gain to a sum of the applied gain and the applied gain multiplied by a rise rate parameter when the applied gain is not greater than the target gain. The rise rate parameter controls a recovery time of the applied gain. In one embodiment, if the dynamically determined applied gain exceeds 1, it is set to 1.

At 447, the applied gain is applied to the input signal to produce the output signal. In various embodiments, additional sound processing techniques may be applied to further process the output signal before it is delivered to be heard by the listener.

Hearing assistance devices typically include at least one enclosure or housing, a microphone, hearing assistance device electronics including processing electronics, and a speaker or "receiver." Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. In various embodiments of the present subject matter, processing circuit 104, including transient suppression circuit 108 and its various embodiments as discussed in this document, may be implemented in such a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different processors. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing aid for use by a listener, comprising:

a microphone;

a processing circuit configured to receive an input signal from the microphone, filter the input signal, rectify the filtered input signal, generate an envelope of the rectified input signal, accumulate a difference between the rectified input signal and the envelope, determine an applied gain based on the accumulated difference, and produce an output signal by applying the applied gain to the input signal in frequency domain; and a speaker configured to receive the output signal from the processing circuit and produce output sounds based on the output signal, wherein the hearing aid is configured to be worn by the listener to compensate for hearing loss of the listener.

2. The hearing aid of claim 1, wherein the processing circuit is further configured to decimate the input signal before the rectification of the input signal.

3. The hearing aid of claim 2, wherein the processing circuit is further configured to normalize the accumulated difference using the rectified input signal.

4. The hearing aid of claim 3, wherein the processing circuit is further configured to calculate a target gain using the normalized accumulated difference and determine the applied gain based on the target gain.

5. The hearing aid of claim 4, wherein the processing circuit is further configured to scale the envelope by multiplying the envelope by a threshold shift before the accumulation of the difference.

6. The hearing aid of claim 4, wherein the processing circuit is configured to calculate the target gain by subtracting the normalized accumulator value from 1.

7. The hearing aid of claim 6, wherein the processing circuit is configured to set the target gain to a minimum target gain value when the calculated target gain is less than the minimum target gain.

8. The hearing aid of claim 7, wherein the processing circuit is configured to set the applied gain to the target gain when the applied gain is greater than the target gain.

9. The hearing aid of claim 8, wherein the processing circuit is configured to set the applied gain to a sum of the applied gain and the applied gain multiplied by a rise rate parameter when the applied gain is not greater than the target gain, the rise rate parameter controlling a recovery time of the applied gain.

10. The hearing aid of claim 9, wherein the processing circuit is configured to set the applied gain to 1 when the determined applied gain exceeds 1.

11. A method for signal processing in a hearing aid, comprising:

receiving an input signal from a microphone of the hearing aid;

filtering the input signal;

rectifying the filtered input signal;

generating an envelope of the rectified input signal;

accumulating a difference between an amplitude of the rectified input signal and an amplitude of the envelope;

determining an applied gain using the accumulated difference;

producing an output signal by applying the applied gain to the input signal; and producing an output sound based on the output signal using a speaker of the hearing aid, wherein the signal processing includes signal processing in frequency domain.

12. The method of claim 11, wherein determining the applied gain comprises:

calculating a target gain using the accumulated difference; and determining the applied gain based on the target gain.

13. The method of claim 12, wherein calculating the target gain comprises setting the target gain to a minimum target gain value when the calculated target gain is less than the minimum target gain.

14. The method of claim 13, wherein determining the applied gain comprises setting the applied gain to the target gain when the applied gain is greater than the target gain.

15. The method of claim 14, wherein determining the applied gain further comprises setting the applied gain to a sum of the applied gain and the applied gain multiplied by a rise rate parameter when the applied gain is not greater than the target gain, the rise rate parameter controlling a recovery time of the applied gain.

16. The method of claim 15, further comprising normalizing the accumulated difference using the rectified acoustic signal, and wherein calculating the target gain comprises calculating the target gain using the normalized accumulated difference.

17. The method of claim 16, wherein calculating the target gain comprises dynamically calculating the target gain by subtracting the normalized accumulated difference from 1.

18. The method of claim 16, wherein determining the applied gain further comprises setting the applied gain to 1 when the determined applied gain exceeds 1.

19. The method of claim 16, further comprising decimating the input signal before rectifying the input signal.

20. The method of claim 16, further comprising scaling the threshold signal by multiplying the envelope by a threshold shift, and wherein accumulating the difference between the amplitude of the rectified input signal and the amplitude of the envelope comprises accumulating the difference between the amplitude of the rectified input signal and the amplitude of the scaled envelope.

* * * * *